United States Patent [19]

MacDougall

[11] 4,109,251

[45] Aug. 22, 1978

[54] ADJUSTABLE ANTENNA MOUNTING BRACKET

[76] Inventor: James B. MacDougall, 236 E. Wood St., New Lenox, Ill. 60451

[21] Appl. No.: 703,615

[22] Filed: Jul. 8, 1976

[51] Int. Cl.[2] ..... H01Q 1/32

[52] U.S. Cl. ..... 343/715; 343/882; 403/96

[58] Field of Search ..... 343/715, 880, 881, 882; 403/93, 96, 97, 99

[56] References Cited

U.S. PATENT DOCUMENTS

| | | | |
|---|---|---|---|
| 729,432 | 5/1903 | Sidway | 403/96 |
| 2,313,652 | 3/1943 | Lyman | 343/882 |
| 2,329,200 | 9/1943 | Hefele | 343/882 |
| 2,706,608 | 4/1955 | Joseph | 343/882 |
| 3,304,037 | 2/1967 | Candela | 343/882 |
| 3,369,247 | 2/1968 | Bacow | 343/715 |
| 3,944,722 | 3/1976 | Larsen | 343/715 |

FOREIGN PATENT DOCUMENTS

| | | | |
|---|---|---|---|
| 973,619 | 9/1950 | France | 343/881 |
| 1,332,513 | 2/1960 | France | 343/715 |
| 1,016,329 | 9/1957 | Fed. Rep. of Germany | 343/715 |

*Primary Examiner*—Eli Lieberman

[57] ABSTRACT

A device for mounting an antenna on a surface or object, and is particularly suitable for use on a motive vehicle. The device is rotatable to a fixed operative-position for the antenna, which may have the antenna projecting in an upright or vertical direction, even-though the surface on which the device is mounted, is inclined with respect to ground. The fixed operative-position for the antenna may be incrementally varied. Upon the application of an external force, the antenna may be released from the fixed position and rotated to a non-operative position for protecting the antenna, in the event the over head space is limited; and thereafter, the antenna may be returned to the precise operative-position.

11 Claims, 13 Drawing Figures

ADJUSTABLE ANTENNA MOUNTING BRACKET

BACKGROUND OF THE INVENTION

This invention relates generally to devices for mounting antennas, and more specifically relates to a device for mounting an antenna on to a motive vehicle. Still more specifically, the invention relates to a device for mounting an antenna on to various objects and including means to enable the antenna to be moved out of the way of obstructions.

Recently, citizen band (CB) mobile radios are being used extensively throughout the country on passenger cars and trucks, for verbal communications within prescribed small areas. The antenna in a CB system is generally four feet long and attached to a motor vehicle with an antenna mount.

For some of the previously used antenna mounts, holes were drilled into the body of the vehicle, and then the mount was secured with suitable screws and nuts. Other antenna mounts were clamped to the vehicle, and had the advantage of not requiring holes to be made in the vehicle frame. These antenna mounts, for example, were clamped to the lip of a car trunk lid, and the corresponding antenna was positioned normal or perpendicular to the adjacent mounting surface. For the trunk lid having a substantially horizontal surface, the antenna extended in the vertical optimum direction, but for an inclined trunk lid the antenna would also be extending on an incline, which frequently did not provide adequate antenna performance. Also, on many of the late model autos it is sometimes difficult to find a suitable horizontal mounting surface, and consequently the use of such antenna mounts resulted in the antenna extending in an inclined and generally non-optimum direction.

Moreover, with either the aforesaid clamp or screw type antenna mount, the antenna would frequently contact or strike over head obstructions, such as garage doors or small dimensioned tunnels or entranceways leading into loading areas etc., and sometimes would result in permanent damage to the antenna. To avoid this, the antenna was physically removed from the vehicle which was time consuming even for the clamped type antenna mounts, or some antennas were provided with sliding connections for telescoping the antenna segments into a smaller vertical configuration. However, the sliding connections often became corroded and thus formed an electrical insulating barrier, the result of which appreciably reduced antenna performance, and sometimes completely disabled the antenna.

Furthermore, several different types of antenna mounts were required to provide attachment for the variety of different vehicle configurations. Thus, one type of antenna mount was used for attachment to a lip of a car trunk, and another type of antenna mount for a circular bar such, as the a luggage rack or rear view mirror, etc..

Therefore, a primary object of the subject invention is to provide an antenna mount for positioning the antenna in the optimum direction independent of the surface on which the antenna mount is secured.

Another primary object is to provide a movable antenna mount having stationary electrical connections, for transferring electrical signals between the antenna and a receiver or transmitter.

Another primary object of the invention is to provide an antenna mount which may be easily and conveniently pivoted out of the way of an obstruction, for preventing contact therewith.

Another object is to provide an antenna mount, for varying the fixed position of the antenna for optimizing the electrical performance of the antenna.

Another object is to provide an antenna mount capable of being mounted on a plurality of different configurations, such as a planar edge or a cylindrical or rectangular form etc..

Another object of the invention is to provide an antenna mount which can be attached to either a lip of an appendage of a vehicle or to a tubular appendage of a vehicle.

BRIEF DESCRIPTION OF THE DRAWINGS

Referring now to the drawings, in which the same characters of reference are employed to indicate corresponding or similar parts throughout the several figures of the drawings.

DESCRIPTION OF THE PREFERRED EMBODIMENT

Figure 1:
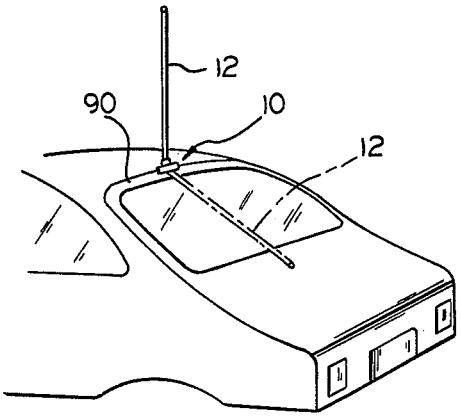
FIG. 1 illustrates the antenna mount, embodying the principles of the invention, mounted on the rear window of an automotive vehicle and showing the antenna in phantom in a downward position.
Figure 2:
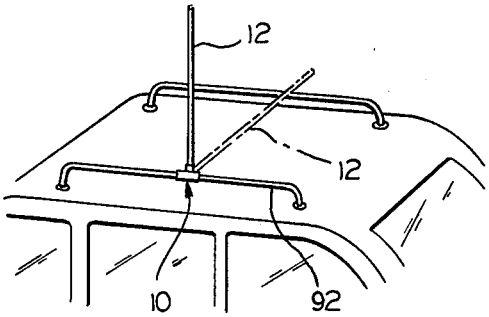
FIG. 2 illustrates the antenna mount secured to the luggage rack on the top of the auto, and showing the antenna in phantom in a downward lateral position.
Figure 3:
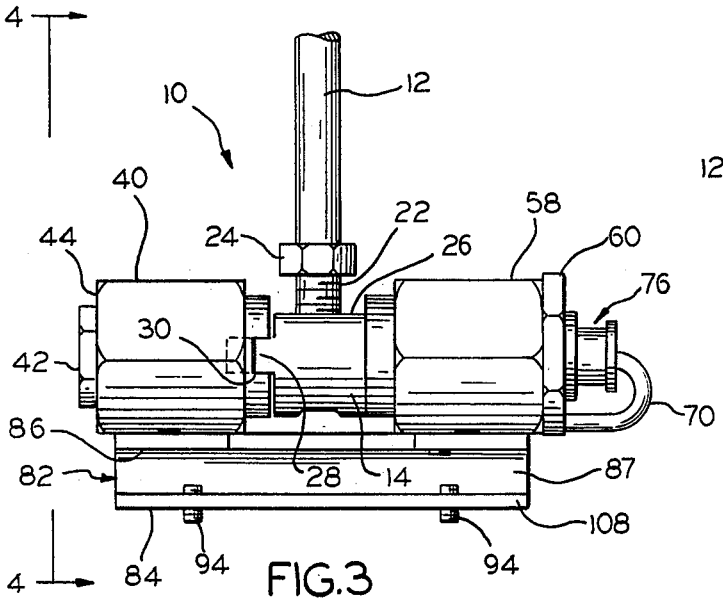
FIG. 3 is a front view of the antenna mount.
Figure 4:
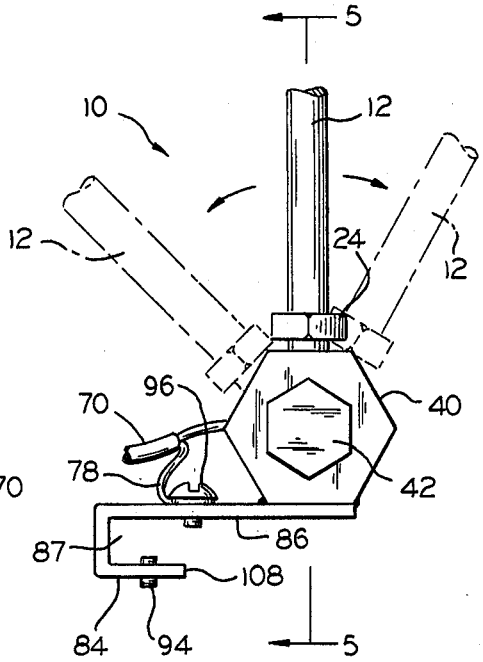
FIG. 4 is an end view of the antenna mount, and showing the antenna segment in phantom being pivoted in opposite directions, and the end view is seen from the plane of the line 4—4 in FIG. 3.

Referring now to the several Figures of the drawings, the reference numeral 10 indicates generally a variable position mounting device for an antenna 12. The device 10 enables the antenna 12 to be pivoted from an upright or vertical fixed, operative-position as shown in FIG. 1 to a downward, non-operative-position shown in phantom, or pivoted from the upright position to the downward lateral position as shown in phantom in FIG. 2.

Figure 5:
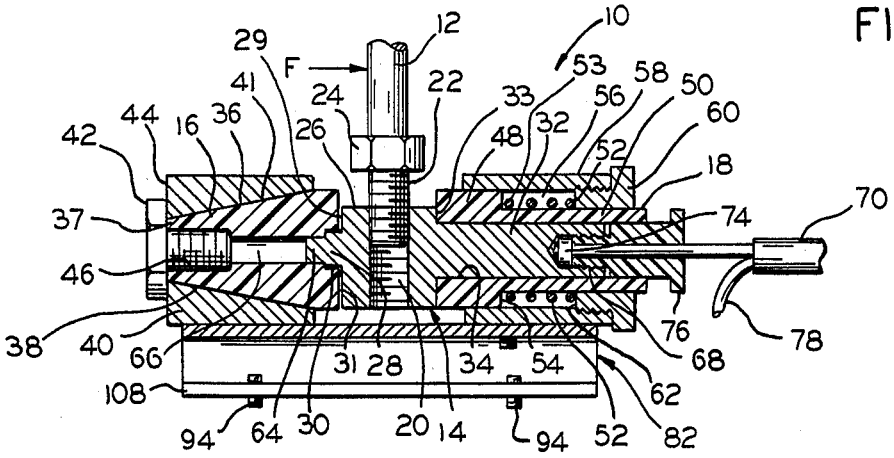
FIG. 5 is a longitudinal sectional view of the mount, and illustrating the mount in a fixed operative position.
Figures 6, 7, 8, 9, 10, 11, 12, 13:
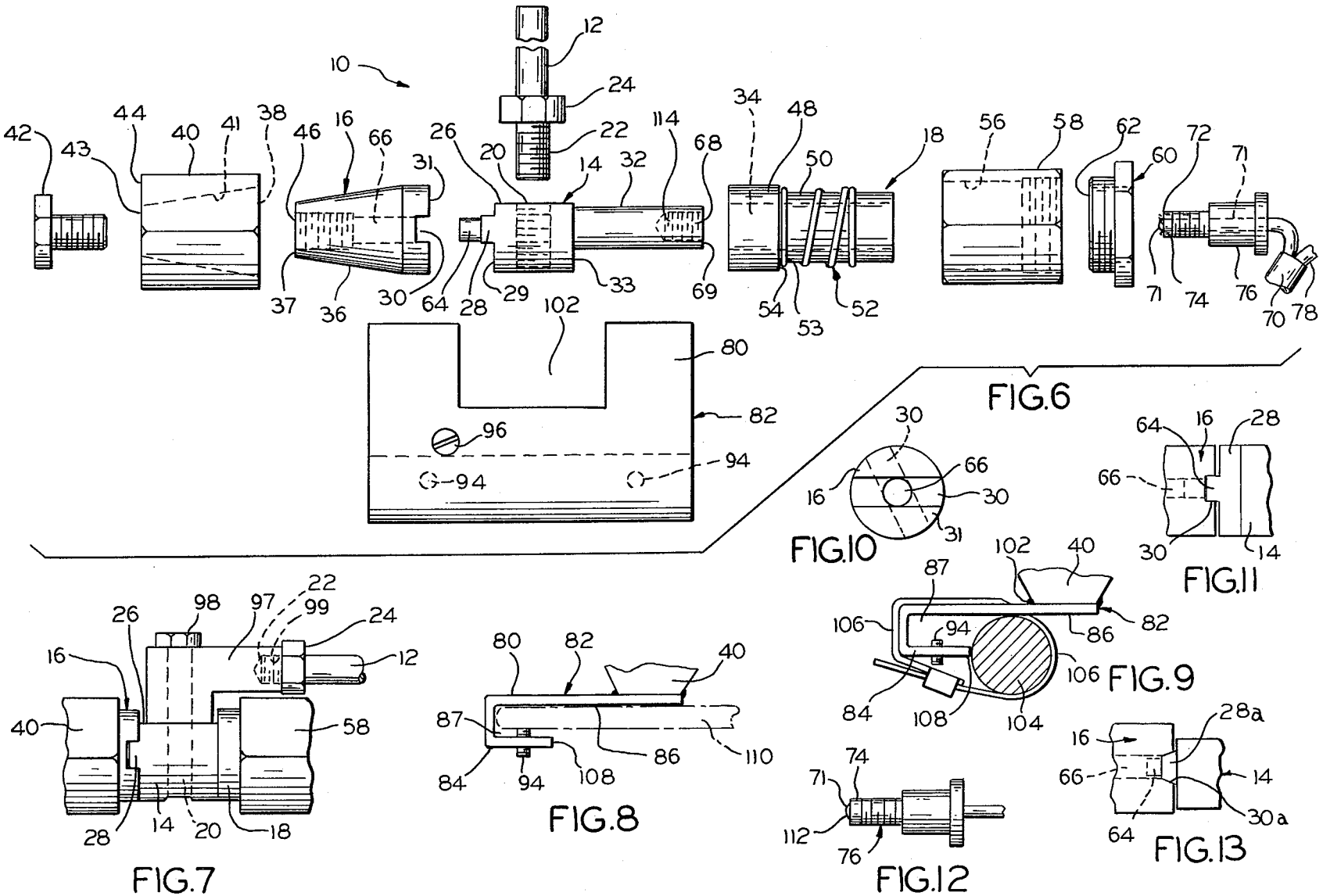
FIG. 6 is an exploded view of the component parts of the antenna mount.
FIG. 7 illustrates an elbow adapter connected between the antenna and the spindle of the antenna mount.
FIG. 8 illustrates the attachment of the base plate of the antenna mount to an object having a thickness less than the space between the bent portion and the bottom surface of the base plate.
FIG. 9 illustrates the attachment of the base plate of the antenna mount to a tubular object having a diameter greater than the space between the bent portion and the bottom surface of the base plate.
FIG. 10 illustrates the elongated groove for setting the fixed position for the spindle.
FIG. 11 illustrates the lug of the spindle dis-engaged from the groove prior to the antenna being pivoted to a non-operative position.
FIG. 12 illustrates the outer end of the central conductor of the coaxial cable having a metal sleeve secured thereon.
FIG. 13 illustrates the lug of the spindle and the groove of the end piece tapered at the same angle.

Turning now more specifically to FIGS. 5 and 6, it will be seen that the device 10 comprises a spindle 14 supported by opposed and spaced apart end pieces 16,18. The spindle 14 includes a threaded opening 20 to receive the threaded bottom end 22 of the antenna 12. The opening 20 is formed transverse or perpendicular to the longitudinal axis of the spindle 14. The spindle 14 is constructed of electrically conductive material suitable for conducting high frequency signals, and the end pieces are constructed of electrically insulative material, such as a suitable teflon or mylar plastic material.

The bottom end 22 of the antenna 12 includes a hex head 24 for engaging a suitable tool when screwing the antenna to the mount 10. The bottom edge of the head 24 may (but need not) lie flush with the flat surface 26 formed adjacent opening 20 in the spindle.

A locking lug 28 protrudes out from one end 29 of the spindle 14 for engagement with an accommodating groove 30 formed inward from the inner edge 31 of the end piece 16. When the lug 28 is received in the groove 30, the end piece 16 is rotated to set the antenna at its operative-position.

A cylindrical rod 32 is integrally formed to the opposite end 33 of the spindle 14 and is positioned inside the hollow cylindrical hole 34 formed in the end piece 18.

The outer surface 36 of the end piece 16 is frusto-conically shaped, tapering in a decreasing cross-sectional circular area from the inner edge 31 to the outer edge 37. The end piece 16 is positioned inside a cavity 38 formed in an end block 40. The defining surface 41 of the cavity 38 is tapered at substantially the same angle as the outer surface 36 of the end piece 16.

A threaded bolt 42 extends through opening 43 in the rear side 44 of the block 40, and is received in the threaded opening 46 formed in the end piece 16. When bolt 42 is loosened or turned to an unlocked-position, end piece 16 is movable inside the block 40 and the spindle 14 is free to rotate. When the bolt 42 is rotated inward or turned to a lock-position, the tapered surface 36 of the end piece 16 tightly engages the tapered surface 41 inside the block 40, and the end piece 16 is no longer movable inside the block 40, and the spindle 14 is thereby locked and unable to be rotated, provided that the lug 28 is retained in the groove 30. The cooperation of the bolt 42 with end piece 16 sets the fixed position for the antenna 12. Since the end piece 16 may be slightly rotated when the bolt 42 is loosened to cause the position of the groove to be slightly varied, the antenna, in turn, is incrementally varied from the original position to another position. If the end piece 16 is rotated a certain angle from an original position, the antenna, will in turn be rotated through the same angle to another position. Securing the lock bolt 42 sets the antenna at a new fixed position.

The end piece 18 includes a cap 48 and a tubular portion 50 extending outward therefrom. The hole 34 extends through both the cap 48 and the tubular portion 50. A compression spring 52 is positioned around the tubular portion 50, and the inner end 53 of the spring abutts the outer edge 54 of the cap 48.

The end piece 18 is positioned inside the cavity 56 formed in an end block 58, which is opposed and spaced apart from the end block 40. A male threaded collar 60 is threadedly received inside the cavity 56 and compresses the spring 52 between the cap edge 54 and the inner edge 62 of the collar 60. The effect of the compressed spring 52 is to resiliently retain or lock the lug 28 inside the groove 30.

When the bolt secures the end piece 16 in position, the fixed position for the antenna is set. If the groove 30 is horizontally positioned as shown in FIGS. 5 and 6, the antenna 12 will be in a fixed vertical position; but if the end piece 16 is rotated so that the groove 30 is angularly positioned with respect to a horizontal or vertical plane, the antenna 12 will also be angularly positioned and held fixed in place by spring 52 locking the lug 28 inside the groove 30.

Turning now specifically to FIG. 5, it will be seen that by applying a side or lateral force F in the direction shown, the spring 52 compresses outward toward the collar 60, and a slight pivoting of the antenna 12 causes the locking lug 28 to disengage from the groove 30. Now, the antenna is free to be rotated from the fixed position determined by the setting of the groove 30. If the force F is removed, the lug 28 will automatically re-lock in groove 30, due to the resilient force of the spring 52 when the antenna 12 is pivoted back to the original fixed position.

A tip 64 extends outward from the locking lug 28 and is received in a central opening 66 formed in the end piece 16 in communication with the groove 30. Even when the locking lug 28 is dis-engaged from the groove 30 as shown in FIG. 12, the tip 64 is still retained in the opening 66, and thereby safeguards the device 10 from jamming when the lug 28 is dis-engaged from the groove 30 and also ensures the re-engagement of the lug with the groove when it is desired to return the antenna to the fixed, operative-position from the non-operative position.

A threaded opening 68 is formed inward from the outer end 69 of the rod 32 of the spindle 14 to receive the coaxial cable 70, and thereby connecting the antenna with the receiver and/or transmitter system (not shown). The cable 70 includes a center conductor 71 which comprises a plurality of strands 72 (FIG. 6). A metal sleeve 74 is positioned around the strands 72 at the inner end of the cable 70 prior to spreading the strands apart. Just slightly outward from the sleeve 74 is a threaded sleeve 76 for engaging the threaded opening 68 in the spindle rod 32. The spread apart strands 72 are tightly sandwiched between the sleeve 74 and inner surface of the opening 68. The flexibility of the center conductor 71 enables the spindle 14 to be pivoted although connected to stationary electrical terminals.

The metal sleeve 74 may be heated first and then slid over the insulation encasing the central conductor 71. The heated sleeve 74 causes the insulation to melt, which forms a securing collar or lip for retaining the sleeve 74 in place. Alternatively, the sleeve 74 may be press fitted or crimped on to the insulation. Thus, the cooperation of the strands 72, metal sleeve 74 and insulation distributes the forces transferred to the cable, as the pivoting of the spindle 16 causes the cable to twist in response thereto.

The outer conductor 78 of the cable 70 provides electrical ground, and is dis-associated from the part of the central conductor inside the rod 32.

The blocks 40 and 58 are rigidly secured, such as by welding or other suitable means, to the top surface 80 of a base plate 82. Base plate 82 includes a bent end portion 84 which is opposed and spaced from the bottom surface 86 of the base plate 82. The space 87 between the bent portion and the bottom surface 86 is dimensioned to permit the mounting device 10 to be positioned on a door, post, trunk lip etc.. In FIG. 1, the base plate 82 is positioned on the lip 90 of the rear car window, and in FIG. 2 the base plate 82 is positioned on the luggage posts 92. A pair of screws 94 are used to fasten the bent end portion 84 to the selected area, in a secure attachment.

A ground screw 96 is positioned in the base plate 82 for mechanically securing the ground conductor 78 of the cable 70. The blocks 40, 58 and plate 82 are constructed of metal, and therefore, are also tied to electrical ground via the conductor 78.

To increase the adaptability of the mount 10, for securing the antenna in the optimum position, an elbow 97 may be used. As shown in FIG. 7, the elbow 97 shifts the antenna position ninety degrees from the position of the antenna 12 in FIG. 5. The elbow 97 is secured to the spindle 14 with the screw member 98, and the antenna 12 is secured to the elbow 97 via the threaded opening 99 receiving the threaded antenna bottom end 22.

As shown in FIG. 6, the base plate 82 includes a rectangular cutout 102 formed therein, which affords greater flexibility for securing the mount 10, to different available mounting surfaces. For example, turn now to FIG. 9, the mount 10 is secured to a cylindrical body 104 having a diameter greater than the space 87 between the bottom surface 86 of the plate and the bent portion 84. A conventional type hose clamp 106 passes through the cutout 102 and tightly locks the cylindrical body 104 against the bottom surface 86 and the outer edge 108 of the base plate 82.

In FIG. 8, the mount 10 is secured to a rectangular bar 110 having a cross-sectional area less than the spacing 87 between the bottom surface 86 and the bent portion 84 of the base plate 82. The bar 110 is in abutting contact with the bottom surface 86 due to the force applied by the screws 94.

In FIG. 12 the strands 72, instead of being free at the tip 112 of the conductor 71 are soldered to the sleeve 74. Preferably, the sleeve 74 is heated with solder, and the conductor strands 72 absorb the heated solder as it is passed through the sleeve 74. The heated sleeve 74 melts the insulation 77 and is thereby securely retained on the insulation of the conductor 71. The tip 112 now tightly fits inside the tapered inner end 114 of the opening 68, and thus affords a positive electrical connection and also functions to distribute forces due to the cable 70 being rotated with the antenna 12. Thus, a fixed electrical connection is maintained, although the cable 70 may be frequently moved and twisted.

In FIG. 13 the groove identified by the reference **30*a* and the lug identified by the reference 28*a*, are shown tapered at the same angle. The complementary taper of the lug 28*a* and the groove 30*a* enables the spindle 14 to dis-engage when an extraordinary force is applied against the antenna 12, as when the car in FIG. 1 is driven into the garage with the antenna still extending vertically. The spring 52 maintains the antenna in the fixed position, and the applied force would cause the spring 52 to compress and the lug 28*a* would slide outward, to permit the antenna to pivot downward. If the force were sufficient the lug would slip completely out of the groove 30*a*** and the spindle would freely rotate the antenna out of the path of the obstruction.

The description of the preferred embodiment of this invention is intended merely as illustrative of this invention, the scope and limits of which are set forth in the following claims.

I claim:

1. A device for varying the position of an antenna comprising:

a spindle including means for connecting to said antenna and an outward extending rod portion;

lock means including an end member having a groove formed therein and a lug protruding out from the spindle for engagement with the groove for locking the spindle at the fixed position, the position of the groove determining the fixed position;

a spring for retaining said lug in said groove, said spindle being movable in the direction for compressing said spring when the spindle is in said fixed position, said lug being dis-engaged from the groove upon the application of an external force for sufficiently compressing said spring;

a cylindrical member having an opening for receiving said rod portion and including an outer collar; and a wall, said spring being positioned between the collar and the wall, the movement of the rod portion toward the spring causing said cylindrical member to move responsively for compressing the spring, for unlocking the spindle from the fixed position to enable said spindle to be rotated away from the fixed position for moving the antenna to a non-operative position.

2. The device of claim 1 includes:

a cable having one conductor connected to the antenna via said spindle.

3. The device of claim 2 includes:

a block having a hole therein to receive said cylindrical member; and a neck member including said wall secured inside said block and having an opening to receive said cylindrical member, said spring moving between the collar of the cylindrical member and said neck member.

4. The device of claim 2, wherein said rod portion includes an opening extending inward from the outer end thereof to receive said one conductor.

5. The device of claim 2 wherein said cable includes:

a metal sleeve attached to the outer end of said one conductor, to afford a greater contact surface for the one conductor.

6. The device of claim 5, wherein said one conductor includes a plurality of strands, the outermost tips of said strands being secured to said sleeve.

7. The device of claim 4, wherein said one conductor includes a threaded sleeve, and said opening of said rod portion is threaded to receive said threaded sleeve.

8. The device of claim 3, wherein said rod portion includes an opening extending inward from the outer end thereof to receive said one conductor, said one conductor extending inside said opening of said collar member to reach said opening inside the rod portion.

9. A device for varying the position of an antenna comprising:

a spindle for connecting to said antenna;

set means for providing a fixed position for said spindle;

said set means including an end member, a block, and securing means, said end member having a groove formed therein and having a tapered outer surface, the position of the groove determining said fixed position, said block having an inner surface for defining a cavity therein, said inner surface being tapered at substantially the same angle as said outer surface of the end member, said securing means being operative for tightening said tapered outer surface against said inner surface to prevent movement of the end member and thereby maintaining said groove in the fixed position, the loosening of the securing means enabling the position of the groove to be varied for varying the fixed position;

lock means for securing the spindle at said fixed position, for setting the operative position for the antenna;

said lock means including a lug protruding out from the spindle for engagement with the groove for locking the spindle at the fixed position;

dis-engage means for unlocking the spindle from the fixed position to enable said spindle to be rotated away from the fixed position for moving said antenna to a non-operative position, said spindle being rotatable back to said fixed position for returning said antenna to the operative position from the non-operative position.

10. The device of claim 9, wherein said securing means includes a bolt having a head and a threaded stem, said end piece including a threaded opening for receiving the stem of the bolt.

11. The device of claim 9, wherein said end member is formed of an electrically insulative material, and said block is constructed from an electrically conductive material.

* * * * *